United States Patent [19]

Foreman

[11] 3,971,716

[45] July 27, 1976

[54] ROCK SEPARATOR

[76] Inventor: Kenneth C. Foreman, P.O. Box 271, Ketchikan, Alaska 99901

[22] Filed: Nov. 27, 1974

[21] Appl. No.: 527,619

[52] U.S. Cl. ..... 209/396; 209/415; 130/26; 198/219

[51] Int. Cl.[2] ..... B07B 1/16; B07B 1/42

[58] Field of Search ..... 209/396, 415, 365 B; 198/219; 130/26

[56] References Cited

UNITED STATES PATENTS

| | | | |
|---|---|---|---|
| 267,599 | 11/1882 | Schneider | 130/26 |
| 274,395 | 3/1883 | Schneider | 130/26 |
| 1,552,397 | 9/1925 | Edwards | 209/396 X |
| 1,703,726 | 2/1929 | Davis | 209/396 |
| 2,112,886 | 4/1938 | Greenawalt | 209/396 X |
| 2,914,177 | 11/1959 | Parks | 209/396 |
| 2,925,911 | 2/1960 | Parks | 209/415 X |
| 3,106,523 | 10/1963 | Couture | 209/396 X |
| 3,412,859 | 11/1968 | Thornton | 209/396 X |
| 3,455,597 | 2/1970 | Schlue | 130/26 |

FOREIGN PATENTS OR APPLICATIONS

| | | | |
|---|---|---|---|
| 678,691 | 1/1964 | Canada | 209/396 |
| 603,045 | 9/1934 | Germany | 209/396 |

*Primary Examiner*—Robert Halper
*Attorney, Agent, or Firm*—Seed, Berry, Vernon & Baynham

[57] ABSTRACT

An apparatus for separating rocks larger than a predetermined size from a mixture of various size rocks utilizing a plurality of transversely spaced, inclined arms. The arms reciprocate back and forth, thereby expediting the flow of the smaller rocks into a hopper below and the larger rocks to roll down the inclined arms. The arms are resiliently supported by springs, and the driving mechanism is mechanically isolated from the arms to protect it from shock and vibration received by the arms.

5 Claims, 2 Drawing Figures

ROCK SEPARATOR

BACKGROUND OF THE INVENTION

1. Field of the Invention

This invention relates to screening and separating devices, and more particularly, to such devices utilizing inclined reciprocating arms which are resiliently supported, and a driving means which is mechanically isolated from the arms.

2. Description of the Prior Art

In the fields of mining and road and airport runway construction, it is often necessary to separate rocks larger than a predetermined size from a mixture of various size rocks. For example, rocks for use in highway roadbed construction must be smaller than a predetermined size. Therefore, the larger rocks must be sorted out from quarried rocks of various sizes. Prior art devices commonly employ some form of mesh or metal grates, and the larger material must be removed periodically, thereby suspending operation of the sorter. These prior art devices are generally not very efficient since each part of the mesh or grate is stationary with respect to the rest of the mesh or grates. As a result, rocks often become lodged in the mesh or between the grates, thereby clogging up the separator. While it was often easy to overcome this problem in theory, the rough treatment that rock sorters receive made implementation of these solutions impractical.

It is an object of this invention to provide a self-cleansing separator which inhibits clogging and, thus, is more efficient than prior art devices.

It is another object of this invention to provide a sorting and separating mechanism which is extremely rugged and, therefore, capable of withstanding heavy loads dropped from above.

It is a further object of this invention to protect the driving mechanism from the shocks imposed upon the reciprocating separating arms.

It is still another object of the present invention to devise a rock sorter in which sorted material may be removed while the machine is operating.

SUMMARY OF THE INVENTION

According to the present invention, a plurality of inclined arms reciprocate with respect to their adjacent arms. The arms are resiliently supported by springs pivotally secured to a frame below. The arms reciprocate in two units, each unit comprising alternate arms. Each unit is driven both along and perpendicular to their longitudinal axis by a rotating crankshaft which is mechanically isolated from the rest of the unit.

In operation, a mixture of various size rocks is dumped onto the separating arms, and the reciprocating arms prevent the mixture from lodging between adjacent arms. The small rocks fall between the arms into a hopper below, and the rocks larger than a predetermined size roll down the arms to a collector. The reciprocating action prevents the mixture from clogging the arms, thus making the device extremely efficient, and the resilient supports make it extremely rugged.

DESCRIPTION OF THE PREFERRED EMBODIMENT

Figure 1:
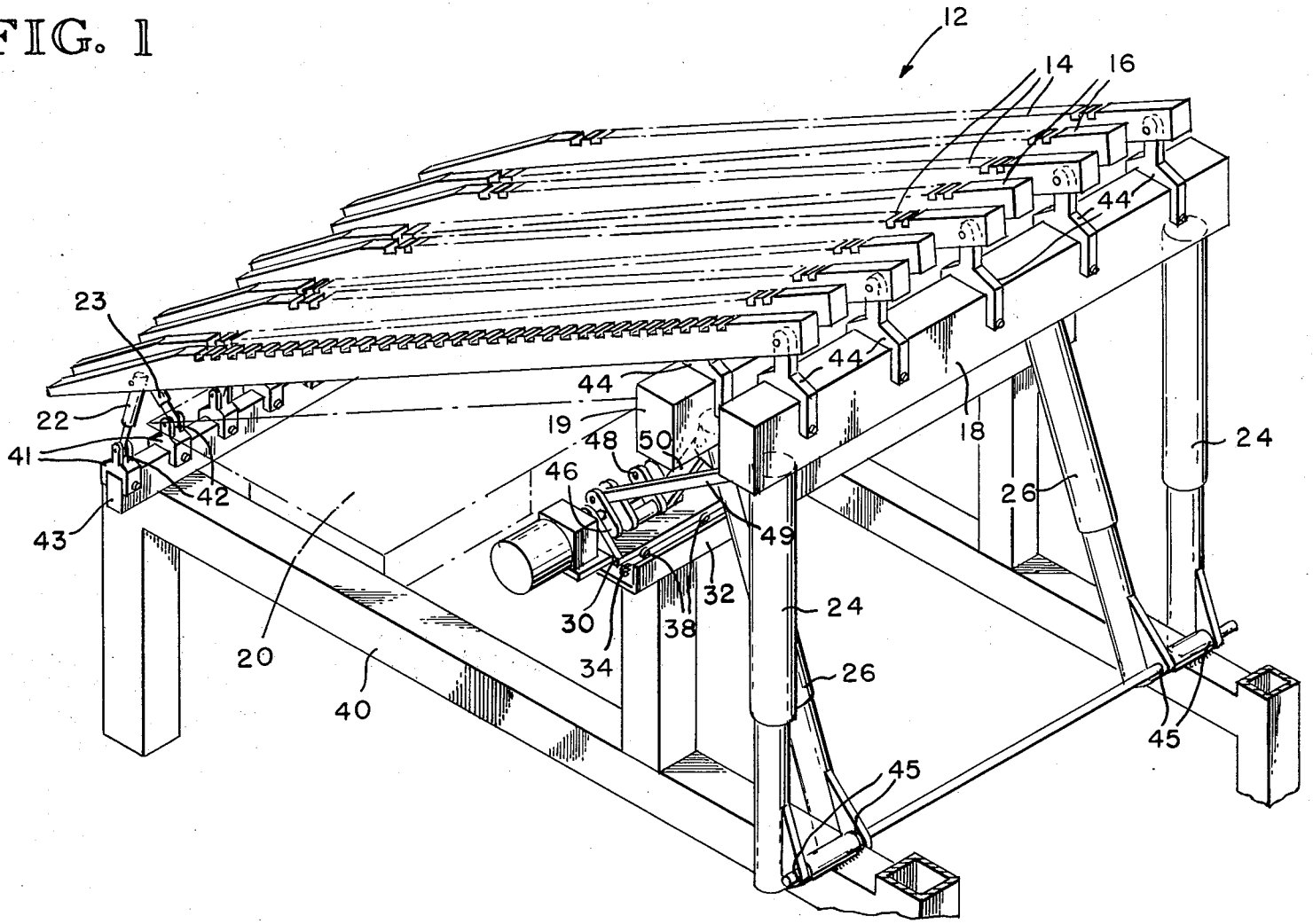
FIG. 1 is a perspective view of the rock separator of the present invention.
Figure 2:
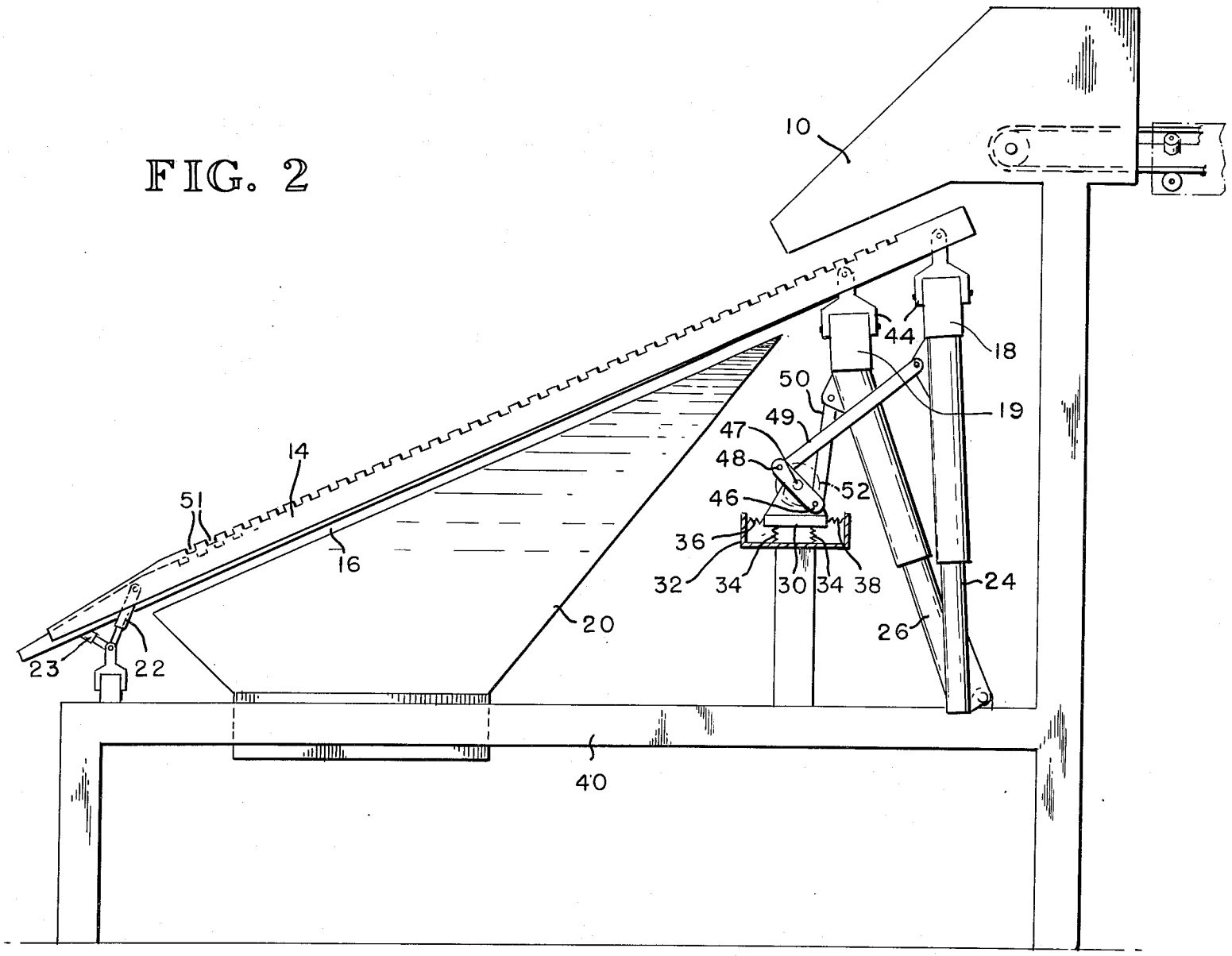
FIG. 2 is a side view of the rock separator of the present invention.

Referring to FIGS. 1 and 2, alternating sorting arms 14 are pivotally secured to beam 18 through support members 44. Similarly, alternating sorting arms 16 are secured to beam 19 through support members 44. Beams 18 and 19 are supported by springs 24 and 26 which are pivotally secured to frame 40 at 45.

The lower ends of the sorting arms 14 and 16 are supported by stationary beam 43 through springs 22 and 23 which are pivotally secured to support members 41 at 42. Springs 22 and 23 are similar to springs 24 and 26, except that their spring constants are modified to compensate for the fact that each spring supports only one sorting arm. When the springs 22, 23, 24 and 26 pivot, their upper ends travel in circular arcs. Thus sorting arms 14 and 16 reciprocate in both a vertical and horizontal direction.

Beams 18 and 19 are caused to reciprocate by drive rods 49, 50 pivotally connected to opposed cranks on rotating crankshaft 48. Crankshaft 48 is carried by support 46 which is affixed to shock mounted frame 30. A motor 52, also affixed to shock mounted frame 30, is interconnected to and rotates the crankshaft 48, thereby causing beams 18 and 19 to reciprocate. Shock mounted frame 30 is resiliently supported by stationary base 32 through springs 34, 36 and 38. Stationary base 32 is fixedly secured to frame 40.

It is apparent that most of the shock imparted to the sorting arms 14 and 16 is not transmitted to any of the mechanisms mounted on shock mounted frame 30. Similarly, shocks transmitted to frame 40 through springs 22, 23, 24 and 26 will be attenuated by springs 34, 36 and 38 to prevent damage to the more delicate mechanisms mounted on shock mounted frame 30.

The sorting arms 12 and 14 have formed therein a plurality of teeth 51 on their top surfaces to improve their efficiency by inhibiting the flow rate of the rocks and increasing the sorting action. The size of the teeth 51 may be varied to provide optimum performance, depending on the characteristics of the material to be sorted.

A chute 10 is suspended above the sorting arms 14 and 16 at an incline, with its uppermost end at a position for receiving raw material. A hopper 20 is carried below the sorting arms 14 and 16 to funnel the smaller rocks to a container (not shown). Rocks larger than a predetermined size roll down the sorting arms 14 and 16 and into a container (not shown) adjacent the frame 40.

The inter-arm spacing can be varied to sort out rocks of any desired size. The spacing can be quickly and easily modified simply by relocating the support members 44 on beams 18 and 19 and support members 41 on beam 43.

In operation, a load of raw material is dumped onto the chute 10 and allowed to slide down onto the sorting arms 14 and 16. Springs 22, 23, 24 and 26 compress under the load to absorb the shock received by the sorting arms 14 and 16. Motor 52 rotates crankshafts 46 and 48 thereby reciprocating beams 18 and 19 through drive rods 49 and 50, and causing sorting arms 14 and 16 to reciprocate both along and perpendicular to the longitudinal axis of the arms 14 and 16. This reciprocating action causes the smaller rocks to fall into hopper 20 and the rocks larger than a predetermined size to roll down sorting arms 14 and 16, thereby completing the separation process. The rock sorter of the present invention may be continuously operated since it is not necessary to suspend sorting to remove material from the arms as in prior art devices.

The beam 19 is positioned closer to the motor 52 than the beam 18. Therefore, the drive rod 49 is, of necessity, longer than the drive rod 50, and the angle of inclination of the drive rod 49 is different from the angle of inclination of drive rod 50. This geometry causes the phasing of one beam 18 to differ from that of the other beam 19 such that at times both beams move in the same direction horizontally and at other times in the opposite direction horizontally. The relative vertical movement between the beams 18, 19 is also out of phase in the same manner. The result is a random-like relative movement between the beams 18, 19 causing a random-like movement of the sorting arms 14, 16.

Although the sorting arms are subject to great shock, this stress is isolated from the relatively delicate parts of the sorter, thereby prolonging their life and allowing them to be constructed of lighter and, therefore, cheaper material. The reciprocating action prevents the mixture from becoming lodged between the arms to ensure high efficiency, and all of the material placed on the sorting arms either falls below them or rolls off their lower end, thus obviating the necessity for manually removing the sorted product from the arms.

The embodiments of the invention in which a particular property or privilege is claimed are defined as follows:

1. A rock separator comprising:

a rigid frame;

a first set of parallel interconnected sorting arms;

a second set of parallel, interconnected sorting arms, the sorting arms in said first set being positioned in alternating spaced relationship with the sorting arms in said second set;

means for supporting said first and second sets of sorting arms on said frame;

a shock absorbing support table mounted on said frame, said support table having a mounting surface fixedly secured to said frame and a shock isolation surface resiliently supported by said mounting surface; and powered means for imparting a random-like reciprocating motion to first and second drive rods connected to said first and second sets of sorting arms respectively, said powered means being mounted on said isolation surface such that the shock imparted to said frame by said arms is substantially isolated from said powered means.

2. The rock separator of claim 1 further including:

a first beam interconnecting one end of said first set of sorting arms;

a second beam interconnecting one end of said second set of sorting arms;

a first pair of springs pivotally secured to said frame at one end and affixed to said first beam at the other;

a second pair of springs pivotally secured to said frame at one end and afixed to said second beam at the other end; and a plurality of springs, each of said springs extending between said frame and one of said sorting arms.

3. The rock separator of claim 2 wherein said powered means includes a rotating power source mounted on said shock isolation surface and driving a crankshaft having first and second lobes, and wherein one end of said first drive rod is connected to said first lobe and the other end is pivotally connected to said first beam, and one end of said second drive rod is connected to said second lobe, and the other end is pivotally connected to said second beam.

4. A rock separator comprising:

a first set of parallel sorting arms having one of their ends interconnected through a first beam;

a second set of parallel sorting arms having one of their ends interconnected through a second beam, the sorting arms in said first set being positioned in alternating spaced relationship with sorting arms in said second set;

a frame;

a crankshaft having first and second lobes, said crankshaft being driven by a source of rotating power;

means connected to said arms at a point longitudinally spaced from said beams for supporting said arms on said frame;

first and second links having one of their ends pivotally connected to a common point on said frame and their opposite ends connected, respectively, to said first and second beams, said first beam being spaced closer to said crankshaft than said second beam;

a first drive rod having one end pivotally connected to said first link and the opposite end engaging the first lobe of said crankshaft; and a second drive rod having one end pivotally connected to said second link and the opposite end engaging the second lobe of said crankshaft, said second drive rod being longer than the said first drive rod.

5. The rock separator of claim 4, wherein said links are resilient such that the length of said link is a function of the force imparted to said links in a longitudinal direction, and said crankshaft and powered means are mounted on a shock isolation surface which is resiliently supported by a mounting surface fixedly secured to said frame thereby isolating said power means and crankshaft from said frame.

* * * * *